US006015333A

United States Patent [19]

Obeng

[11] Patent Number: 6,015,333

[45] Date of Patent: Jan. 18, 2000

[54] METHOD OF FORMING PLANARIZED LAYERS IN AN INTEGRATED CIRCUIT

[75] Inventor: Yaw Samuel Obeng, Orlando, Fla.

[73] Assignee: Lucent Technologies Inc., Murray Hill, N.J.

[21] Appl. No.: 09/135,260

[22] Filed: Aug. 17, 1998

Related U.S. Application Data

[62] Division of application No. 08/769,717, Dec. 18, 1996, Pat. No. 5,836,805.

[51] Int. Cl.[7] ..... B24B 49/00

[52] U.S. Cl. ..... 451/8; 451/36

[58] Field of Search ..... 451/1, 8, 36, 41, 451/63

[56] References Cited

U.S. PATENT DOCUMENTS

| | | | |
|---|---|---|---|
| 5,483,568 | 1/1996 | Yano et al. . | |
| 5,575,706 | 11/1996 | Tsai et al. | 451/41 |
| 5,624,300 | 4/1997 | Kishii et al. | 451/36 |
| 5,643,050 | 7/1997 | Chen | 451/10 |
| 5,664,990 | 9/1997 | Adams et al. | 451/60 |
| 5,685,766 | 11/1997 | Mattingly | 451/36 |
| 5,722,875 | 3/1998 | Iwashita et al. | 451/8 |

OTHER PUBLICATIONS

Schumacher, Rolf, Angewandte Chemie, "The Quartz Microbalance: A Novel Approach to the In–situ Investigation of Interfacial Phenomena at the Solid/Liquid Junction", pp. 329–343, vol. 29, No. 4, Apr. 1990.

Hillman, A. Robert, Swann, Marcus J., and Bruckenstein, Stanley, "General Approach to the Interpretation of Electrochemical Quartz Crystal Microbalance Data", J. Phys. Chem. 1991, pp. 3271–3277.

Buttry, D.A., Publication Electrochemistry in Electroanalytical Chemistry, "Applications of Quartz Crystal Microbalance to Electroanalyatical Chemistry", pp. 1–85, vol. 17.

*Primary Examiner*—Timothy V. Eley

[57] ABSTRACT

A method of chemical mechanical polishing (CMP) useful in the manufacture of integrated circuits is disclosed. Waste slurry is examined and its conductivity, luminescence, or particulate mass evaluated to determine an endpoint for the CMP operation.

3 Claims, 2 Drawing Sheets

METHOD OF FORMING PLANARIZED LAYERS IN AN INTEGRATED CIRCUIT

This Application is a Divisional of application Ser. No. 08/769,717, filed on Dec. 18, 1996, now U.S. Pat. No. 5,836,805, to Yaw S. Obeng. The above-listed Application is commonly assigned with the present invention and is incorporated herein by reference as if reproduced herein in its entirety under Rule 1.53(b).

TECHNICAL FIELD

This invention relates to methods for the manufacture of integrated circuit, in general, and more particularly, to methods of forming planarized layers in such integrated circuits.

BACKGROUND OF THE INVENTION

Many modern integrated circuits generally include several layers of metallic or conductive wiring (often termed "runners") which are surrounded and covered by dielectrics, illustratively formed from silicon dioxide. The presence of gates and field oxides, together with the conformal properties of deposited silicon dioxide, tend to make dielectrics very bumpy or uneven. The unevenness of dielectrics makes the formation of additional levels of reliable conductors problematic. Consequently, it is desired to planarize or smooth either dielectric layers or conductor layers. One method for planarizing dielectrics and/or conductors is a chemical-mechanical polishing (CMP). CMP has become a widely used technique for the planarization of both dielectric and metallic layers due to the high degree of global planarity that CMP provides. During CMP processing, the wafer, having partially fabricated integrated circuits thereon, is polished upon a polishing wheel. The resulting upper surface, being either dielectric or metal, becomes highly planar and provides a suitable base for a substrate upon which further layers of conductors or dielectrics may be formed.

However, those concerned with development of CMP techniques have found that it is difficult to determine when to stop the grinding or polishing of the dielectric or metallic layer. Frequently, the wafer is polished for an initial period of time. Then the wafer is removed from the polishing wheel and the thickness of the upper layer is measured. If needed, further polishing is performed for an additional period of time (and if needed, the process is repeated) until the desired layer thickness is achieved. The polishing rate of both dielectric and metals depends on a large number of factors and the polishing rate is therefore somewhat is variable. The variability of the polishing rate complicates the problem of obtaining consistent layer thickness.

Those concerned with the development of integrated circuit processing have consistently sought reliable and effective methods for detecting an appropriate end point so that CMP may be terminated without unduly repetitive measurements.

SUMMARY OF THE INVENTION

Various methods of integrated circuit fabrication are disclosed, including:

i) subjecting a wafer having an overlying layer of metal to a polishing operation in a slurry; thereby producing a waste slurry;

measuring the conductivity of the waste slurry; and terminating the polishing operation after the conductivity begins to decrease.

ii) subjecting a wafer having an overlying layer of dielectric to a polishing operation in a slurry; thereby producing a waste slurry;

measuring the luminescence of the waste slurry; and terminating the polishing operation after the accumulation of said luminescence reaches a predetermined value.

iii) subjecting a wafer having an overlying layer of dielectric to a polishing operation in a slurry; thereby producing a waste slurry; having particles therein;

measuring the quantity of particles in said waste slurry with a quartz microbalance; said microbalance having a frequency;

terminating the polishing operation when the frequency reaches a predetermined value.

Detailed Description

Figure 3:
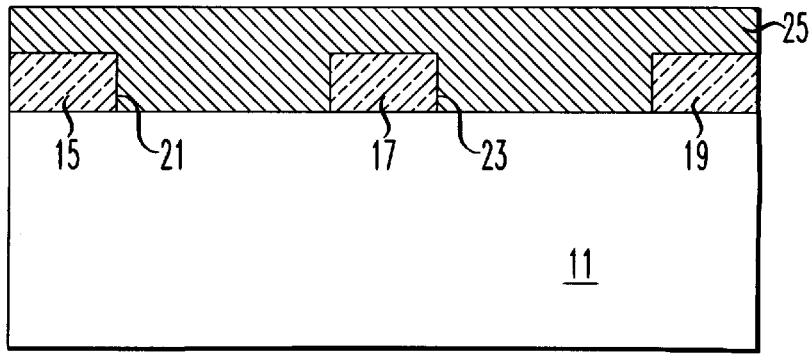
FIGS. 3, 4 and 6 are schematic cross sectional views, also useful in understanding an illustrative embodiment of the present invention.

Sometimes it is desired to apply the CMP technique to a metal layer, such as tungsten, aluminum, or alloys thereof. In FIG. 3, reference numeral 11 denotes a substrate which may be a dielectric, a conductor or a semiconductor (which may have doped portions therein). Reference numeral 15, 17, and 19 denote portions of a patterned dielectric layer. Windows or vias 21 and 23 have been created in the patterned dielectric layer represented by 15, 17 and 19. A metal, illustratively tungsten or aluminum denoted by reference numeral 25 has been deposited in vias 21 and 23. (Other possibilities for metal 25 are: tungsten alloys, aluminum-silicon, aluminum-silicon-copper, and transition metals.) Metal 25 also overlies the upper surfaces of patterned dielectric 15, 17 and 19. It is desired to planarize or grind down metal 25, thereby creating metallic plugs within vias 21 and 23.

Methods for grinding metallic and metallic alloy layers, such as tungsten, and its alloys, aluminum, aluminum-copper, aluminum-silicon-copper, and copper are well known to those of skill in the art. However, it is difficult to determine with any precision just when the grinding process should be stopped.

For example, tungsten is frequently polished using iodate as an oxidant in an alumina slurry. The following reactions are observed:

$$3IO_3^- + 16e^- \xrightarrow{H^+} I_3^- + 9H_2O$$

$$2W + H_2O \xrightarrow{H^+} W_2O_3 + 6e^-$$

Figure 1:
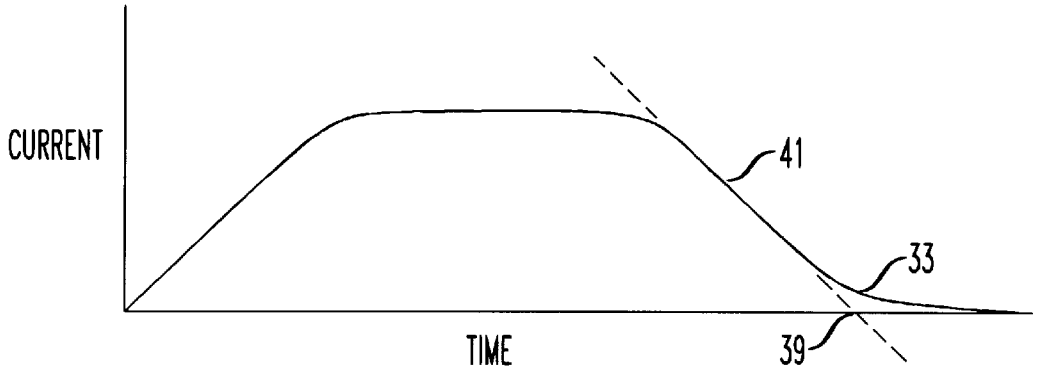
FIGS. 1 and 2 and 7 are graphs useful in understanding a illustrative embodiments of the present invention.
Figure 4:
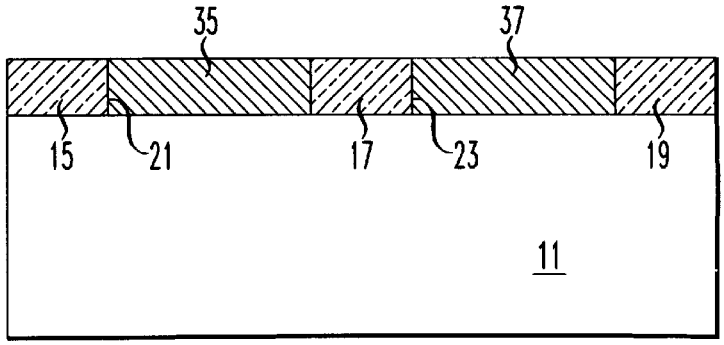
Figure 5:
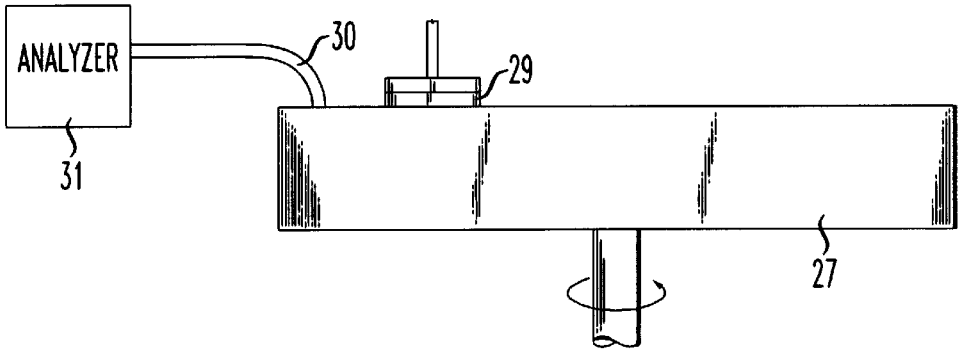
FIG. 5 is a schematic view of equipment used in an illustrative embodiment of the present invention.

The oxidant reactions described above produce electromotive $I_3^-$ which may be sampled via a tube positioned near the wafer being ground. For example, in FIG. 5, reference numeral 27 denotes a grinding or polishing wheel while reference numeral 29 denotes a wafer being subjected to the grinding process. Tube 30 samples the waste slurry for measurement by analyzer 31. It will be observed that, as illustrated in FIG. 1, that the conductivity of the waste slurry or the current which passes through the waste slurry rises gradually as a function of time, levels off, then decreases. It is desired to terminate the CMP process when the configuration of FIG. 4 is obtained. In other words, when that portion of metal layer 25 above patterned dielectric 15, 17 and 19 is removed, leaving only plugs 35 and 37, the process should be terminated. The configuration of FIG. 4 is obtained when the current of the graph of FIG. 1 reaches a point of denoted approximately by reference numeral 33. It should be noted that the current never actually decreases to zero because the exposed portion of plugs 35 and 37, still under attack by etchant in the slurry will produce conductive ions. Nevertheless a suitable endpoint in time, denoted by reference numeral 39 may be obtained by extrapolation of the slope of the declining portion of the curve of FIG. 1 denoted by reference numeral 41. Thus, to determine a suitable endpoint for CMP of the structure of FIG. 3, thereby producing the structure of FIG. 4, one needed merely observe the current or conductivity behavior as a function of time of the waste slurry and either select an appropriate point along the decreasing portion of the curve denoted by reference numeral 41, or, if desired, extrapolate the curve through the axis. For rapid and efficient endpoint detection a multichannel electrode system may be used. The details of multichannel electrode systems are described in Unwin, P. R., Compton, R. G., "The Use of Channel Electrodes in the Investigation of Interfacial Reaction Mechanism in Chemical Kinetics," Vol. 29, 1989, Elsezier, Amsterdam, incorporated herein by reference.

Figure 2:
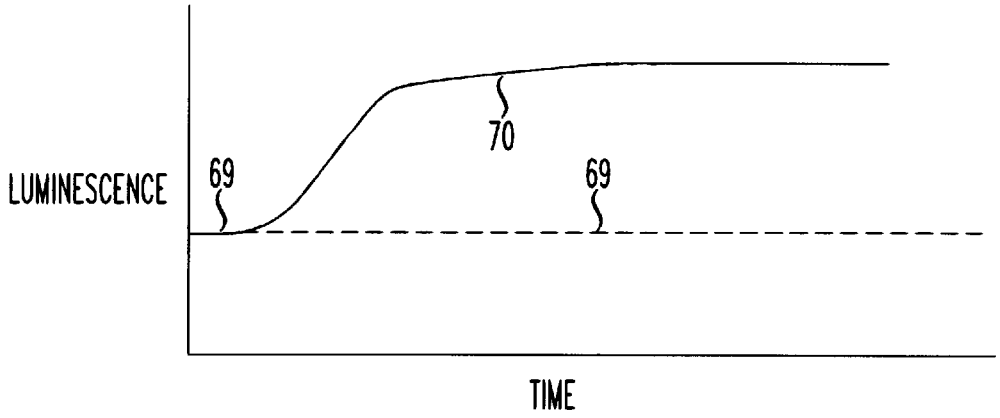
Figure 6:
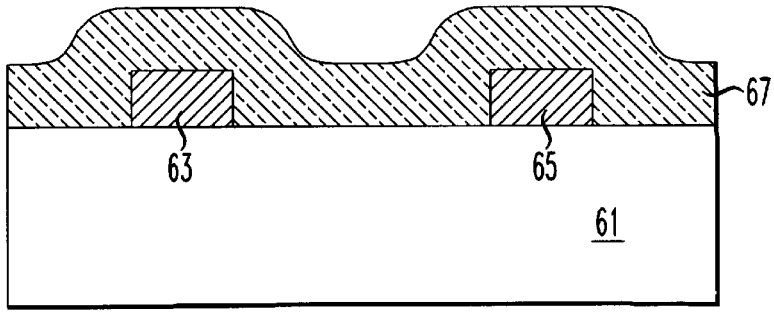

On other occasions it is desired to polish dielectric. For example, in FIG. 6, reference numeral 61, denotes any suitable substrate which may be conductive, dielectric, or semiconductive (with appropriate dopings). Reference numerals 63 and 65 denote topographic features which may be gates, runners, field oxides, etc. Reference numeral 67 denotes a conformally deposited dielectric which may illustratively be formed from a chemical precursor such as TEOS, etc. It is desired to subject dielectric 67 to a CMP process to planarize dielectric 67. Apparatus similar to that depicted in FIG. 5 may be used (with different analysis apparatus 31, of course). The waste slurry from the CMP dielectrics contains both suspended slurry silica and oxide particles. Both dielectric/oxide and silica are luminescent. Consequently, one of may use apparatus to interrogate the waste slurry by radiation with light and monitor the luminescence at a appropriate wave length, thereby producing a graph similar to that depicted in FIG. 2. Base line level 69 may be interpreted as luminescence of the waste slurry. That portion of the curve depicted in FIG. 2 and denoted by reference numeral 70 is the luminescence due to removed particles of dielectric 67. Intergration of the curve depicted in FIG. 2 provides a measure of the total amount of dielectric 67 removed. When the integral reaches a predetermined limit, an alarm may be set and the CMP process may be terminated. For example, if the radius of the wafer is $r_1$, and the initial thickness of oxide is $t_1$ and the final desired thickness is $t_2$, then the volume of oxide to be removed is $=\pi r^2 (t_1—t_2)$. If the oxide has a specific luminescence of $\Phi_1$/gm and the density of the oxide film is $\phi$, then the integrated luminescence of the oxide to be removed is given by $$I(\text{oxide}) = \frac{[\pi r^2(t_1 - t_2)] * \phi}{\Phi_1}$$

If the background luminescence is given by $I_t$, then the endpoint may be indicated by $$\int I dt = I_t + I(\text{oxide})$$

In another illustration, a quartz crystal microbalance may also be utilized to assist in endpoint detection in either dielectric or metal CMP processes. The frequency of the quartz microbalance is proportional to the amount of the material collected. Details of quartz microbalance operation are provided in the following references: Quartz Microbalance, Hillman, A. R., Swann, M. J., Bruckenstien, S. J. Phys. Chem 1991, 95/(8), 3271–3272; Schumacher R., Angew. Chem. International, Ed. English, 1990, 29, 329–343; Buttry, D. A. "Applications of Quartz Crystal Microbalance to Electrochemistry in Electroanalytical Chemistry", Bard, A. J. editor, Marcel Dekker, Inc., N.Y., all of which are incorporated by reference.

Figure 7:
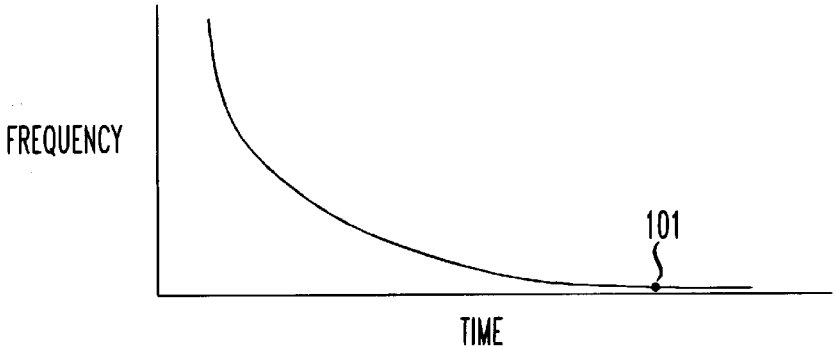

Use of a quartz microbalance will produce a graph similar to FIG. 7. The microbalance is first calibrated by exposing it to slurry (using an arrangement similar to FIG. 5) without any dielectric or metal removal. Then a CMP process is performed and either metal (as in FIGS. 3–4) or dielectric (as in FIG. 6) is removed. The CMP process is terminated when the frequency of the quartz microbalance reaches a predetermined value 101. The polishing operation may be terminated when the frequency of the microbalance decreases to a predetermined value.

The invention claimed is:

1. A method of polishing an integrated circuit comprising:

polishing a wafer having an overlying layer of dielectric with a polishing slurry and a polishing pad;

removing the polishing slurry from the pad to form a waste slurry;

measuring a physical property of said waste slurry; and terminating said polishing operation after said physical property reaches a predetermined value.

2. The method as recited in claim 1 wherein measuring a physical property includes measuring a quantity of particles in said waste slurry with a quartz microbalance, said microbalance having a frequency; and terminating includes terminating said polishing when said frequency reaches a predetermined value.

3. The method as recited in claim 1 wherein measuring a physical property includes measuring a luminescence of said waste slurry, and terminating includes terminating said polishing operation after an accumulation of said luminescence reaches a predetermined value.

* * * * *